United States Patent [19]

Roberts

[11] Patent Number: 4,547,755

[45] Date of Patent: Oct. 15, 1985

[54] MICROWAVE CIRCUIT STRUCTURE AND METHOD OF MOUNTING

[75] Inventor: John E. Roberts, Los Altos, Calif.

[73] Assignee: Watkins Johnson Company, Palo Alto, Calif.

[21] Appl. No.: 593,908

[22] Filed: Mar. 27, 1984

[51] Int. Cl.[4] ..... H01P 1/00

[52] U.S. Cl. ..... 333/246; 174/52 FP; 361/399

[58] Field of Search ..... 333/238, 246; 361/399, 361/415; 174/52 FP; 339/17 CF

[56] References Cited

U.S. PATENT DOCUMENTS 3,904,262 9/1975 Cutchaw ..... 339/17 CF 4,156,211 5/1979 Buswell et al. ..... 333/246 X 4,331,942 5/1982 Matsunaga et al. ..... 333/246 X 4,422,703 12/1983 Christensen et al. ..... 339/17 CF X 4,423,467 12/1983 Shaheen ..... 174/52 FP X

*Primary Examiner*—Paul Gensler

*Attorney, Agent, or Firm*—Flehr, Hohbach, Test, Albritton & Herbert

[57] ABSTRACT

A microwave circuit and housing in which the housing cavity is reduced in size by providing threaded slots in side walls of the housing which receive tabs extending from the microwave circuit carriers. Pillars are inserted in the slots for maintaining the carriers in position on the bottom surface of the housing and for filling the slots. Reduced weight, height, and width is achieved with a reduced number of piece parts.

7 Claims, 4 Drawing Figures

MICROWAVE CIRCUIT STRUCTURE AND METHOD OF MOUNTING

This invention relates generally to microwave circuits, and more particularly the invention relates to a method and structure for mounting microwave circuits in housings.

Microwave circuits such as microwave amplifiers are typically fabricated as hybrid thin film circuits in which conductive patterns and active semiconductor device are provided on a surface of a ceramic substrate. The circuit typically comprises a plurality of substrates which are combined for tuning and testing, and the ceramic substrates are mounted on metal carriers with the carriers then mounted to the bottom surface of a housing. Heretofore, the carriers have been bonded to the housing surface or have been attached by screws extending through tabs on the carriers and into the housing. Bonding the carriers in place makes rework of the ceramic circuits difficult; consequently, an entire circuit is normally discarded if any portion of the circuit is bad. Attachment of the carriers by screws facilitates rework of the hybrid circuits; however, the size of the housing and cavity must be increased to accommodate the tabs and screw threads. This is particularly disadvantageous with microwave circuits designed for aerospace applications. Further, for microwave circuits operating above 10 GHz the circuit cavity is important in preventing moding during circuit operation. To prevent moding during circuit operation the cavity must be limited in size to the width of the ceramic substrates. Therefore, space is not available within the cavity for the mounting tabs at frequencies above 10 GHz.

Accordingly, an object of the present invention is an improved method of mounting microwave circuits in a housing.

Another object of the invention is an improved microwave circuit structure.

Yet another object of the invention is a microwave circuit and housing structure which facilitates mounting and removal of circuits for testing and rework.

A feature of the invention is the use of slots in the side walls of a cavity for accommodating carrier tabs.

Another feature of the invention is the use of threaded pillars for affixing a microwave carrier in a housing and filling the slots in the housing side walls.

The invention and objects and features thereof will be more readily apparent from the following detailed description and appended claims when taken with the drawing, in which:

Figure 1:
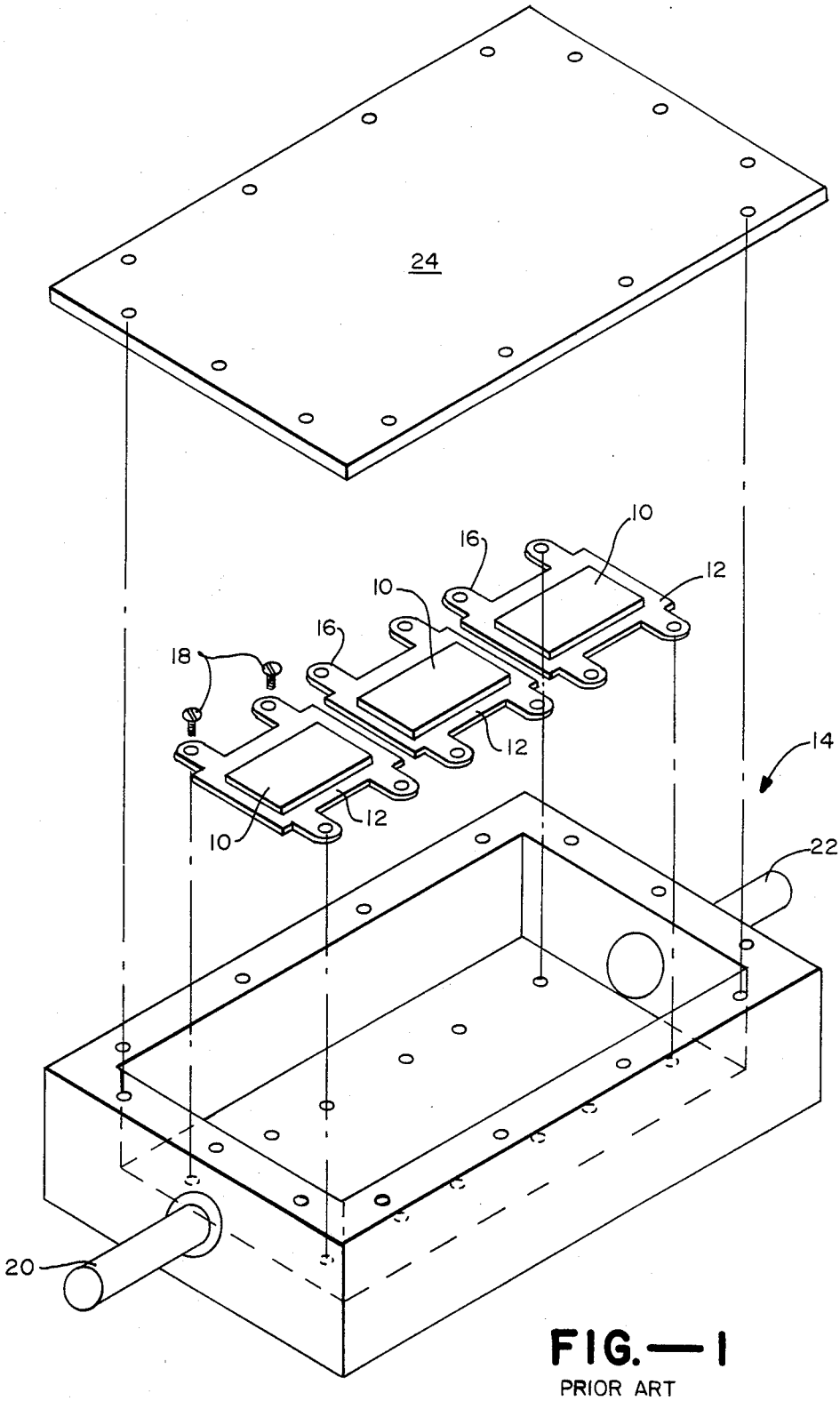
FIG.—1 PRIOR ART
FIG. 1 is an exploded perspective view of a conventional microwave circuit in accordance with the prior art.

Referring now to the drawings, FIG. 1 is an exploded perspective view of a conventional microwave circuit and housing. Typically, a plurality of hybrid circuits 10 comprising a ceramic substrate with the circuit elements defined on a major surface are fixed to carriers 12 for mounting in a housing shown generally at 14. Each of the carriers 12 has a plurality of extending tabs 16 which are fastened to the bottom surface of housing 14 by suitable means such as screws 18. Each of the circuits 10 are interconnected with each other and to input and output connectors 20, 22. A cover 24 is then fastened to the opposing side walls of the housing 14.

As noted above, the size of the housing and cavity must be increased to accommodate the tabs and screw threads. This is particularly disadvantageous with microwave circuits designed for aerospace applications, and the increased size of the cavity can cause moding (i.e. operation in a plurality of modes).

Figure 2:
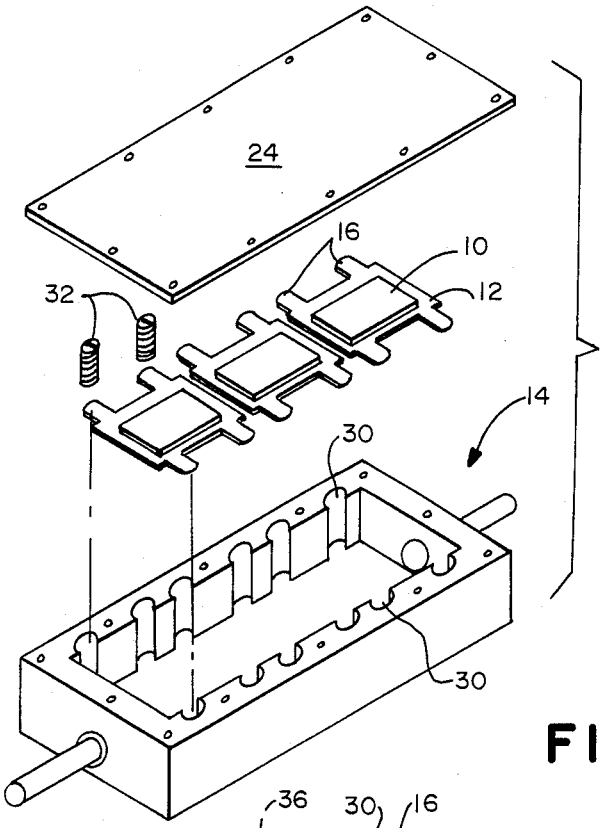
FIG. 2 is an exploded perspective view of a microwave circuit and housing structure in accordance with one embodiment of the present invention.

FIG. 2 is an exploded perspective view of a microwave circuit and housing in accordance with one embodiment of the present invention. The same reference numerals are used for corresponding parts in FIGS. 1 and 2. In this embodiment a plurality of slots 30 are formed in opposing side walls of the housing 14 with the slots positioned to receive the tabs 16 of the carriers 12. Thus, the cavity within the housing 14 can be reduced to the width of the carriers 12 thereby minimizing moding during operation. Pillars 32 are then inserted in the slots 30 to maintain the carrier 12 on the bottom surface of housing 14 and to fill the slots 30, as is necessary for circuit operation. In this embodiment, the slots 30 and pillars 32 are threaded.

Figure 3:
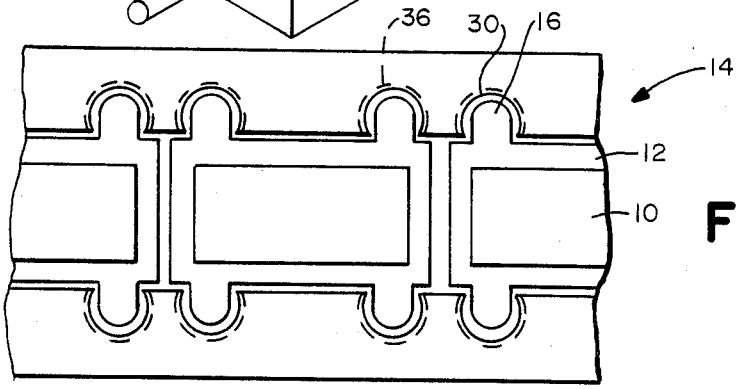
FIG. 3 is a top view of a portion of the structure of FIG. 2 showing the positioning of circuits within the housing.
Figure 4:
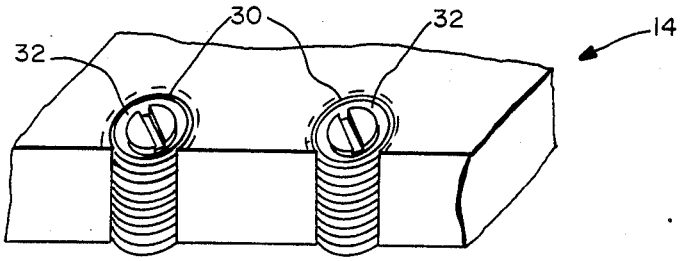
FIG. 4 is a perspective view of a portion of the housing of FIGS. 2 and 3 with threaded pillars therein.

FIG. 3 is a top view of a portion of the housing 14 and carriers 12 showing the positioning of the tabs 16 in the slots 30. The threaded portion of the slots 30 are shown by the dotted lines 36. FIG. 4 is a perspective view of a portion of the housing 14 with threaded pillars 32 in the slots 30. The threaded portion in the slots is greater than 180° therefore maintaining the pillars in the slots. Additionally, since the threaded portion is less than 360° the clamping force is reduced. Importantly, no threaded hole is necessary in the floor.

A microwave circuit and housing in accordance with the invention reduces the weight, height, and width of the packaged circuit and decreases the number of piece parts. Operation at higher frequencies without moding is achieved since the cavity width can be reduced to the width of the circuit carriers.

While the invention has been described with reference to a specific embodiment, the description is illustrative of the invention and is not to be construed as limiting the invention. For example, the pillars could have a press fit in the slots without the need for threads. Thus, various modifications and applications may occur to those skilled in the art without departing from the true spirit and scope of the invention as defined by the appended claims.

What is claimed is:

1. A microwave circuit and housing comprising a housing having a bottom surface and opposing side walls and end walls, a cover for said housing, a plurality of slots in said opposing side walls, said slots being parallel to said side walls and running from one edge to an opposing edge of each side wall, at least one microwave circuit including a substrate having a plurality of tabs extending therefrom, said substrate positioned on said bottom surface with said tabs extending into said slots in said opposing side walls, and pillars engaging and filling said slots and engaging said tabs.

2. The microwave circuit and housing as defined by claim 1 wherein said at least one microwave circuit includes a ceramic substrate with a hybrid circuit formed on at least one major surface thereof, a carrier with the opposite major surface of said ceramic substrate affixed to said carrier, said carrier having said plurality of tabs.

3. The microwave circuit and housing as defined by claim 2 and including a plurality of microwave circuits and means interconnecting said plurality of microwave circuits.

4. The microwave circuit and housing as defined by claim 3 and further including an input connector and an output connector positioned in opposing end walls, and means connecting said connectors to said plurality of microwave circuit.

5. The microwave circuit and housing as defined by claim 1 wherein said plurality of slots and said pillar means are threaded.

6. A method of mounting a microwave circuit including a carrier with tabs in a housing having a bottom surface and side walls comprising the steps of providing a plurality of slots in said side walls, said slots being parallel to said side walls and running from one edge to an opposing edge of each side wall, positioning said carrier on said bottom surface with said tabs extending into said slots, and inserting pillars into said slots thereby maintaining said carrier on said bottom surface and filling said slots.

7. The method as defined by claim 6 wherein said step of inserting pillars into said slots includes threadedly engaging said pillars in said slots.

* * * * *